United States Patent [19]

Sanbongi et al.

[11] Patent Number: 4,896,306

[45] Date of Patent: Jan. 23, 1990

[54] ELECTRONIC SCHEDULER CAPABLE OF SEARCHING SCHEDULE DATA BASED ON TIME

[75] Inventors: Masao Sanbongi, Kunitachi; Minoru Tagi, Fussa, both of Japan

[73] Assignee: Casio Computer Co., Ltd., Tokyo, Japan

[21] Appl. No.: 216,860

[22] Filed: Jul. 8, 1988

[30] Foreign Application Priority Data

Jul. 17, 1987 [JP] Japan ..... 62-109668[U]
Jun. 1, 1988 [JP] Japan ..... 62-71758[U]

[51] Int. Cl.[4] ..... G04B 19/24; G04B 45/00

[52] U.S. Cl. ..... 368/29; 368/41; 368/251

[58] Field of Search ..... 368/41–43, 368/10, 28–30, 223, 72–74, 250–251; 364/705, 569; 340/309.15, 309.4, 706

[56] References Cited

U.S. PATENT DOCUMENTS 4,162,610 7/1979 Levine ..... 368/10
4,548,510 10/1985 Levine ..... 368/10
4,626,836 12/1987 Curtis et al. ..... 340/706
4,715,010 12/1987 Inoue et al. ..... 364/705
4,769,796 9/1988 Levine ..... 368/41

*Primary Examiner*—Vit W. Miska
*Attorney, Agent, or Firm*—Frishauf, Holtz, Goodman & Woodward

[57] ABSTRACT

In an electronic scheduler, date, time and schedule contents are stored in a memory, and then schedule data are read out from the memory to be displayed on a display unit. The electronic scheduler is arranged by a memory device for storing plural of the schedule data by combining at least time range data with corresponding schedule information, an entry device for entering time data as searching information into the electronic scheduler, a comparator for comparing the entered time data with the time range of the respective schedule data stored in the memory device so as to judge whether or not the schedule data corresponds to data to be searched, and a display unit for displaying the corresponding schedule data in response to the judgement result by the comparator.

8 Claims, 9 Drawing Sheets

| F 1 | F 2 | DATE | TIME | CONTENTS OF SCHEDULES | RANK |
|---|---|---|---|---|---|
| 0 | 0 | 880610 | 900 ~ 1200 | MEETING | B |
| 0 | 0 | 880610 | 1300~ 1500 | TENNIS | C |
| | | | | | |

ELECTRONIC SCHEDULER CAPABLE OF SEARCHING SCHEDULE DATA BASED ON TIME

BACKGROUND OF THE INVENTION

1. Field of the Invention

The present invention relates to an electronic scheduler for storing date, time, and schedule contents, and for reading out schedule data from a memory so as to display the read schedule data, if required.

A notebook is widely used to supervise schedules for an individual. Very recently, a so-called "electronic scheduler" is being marketed in which electronic means is employed to supervise schedule data for an electronic scheduler holder. In the conventional electronic scheduler, the date data, time data, and schedule contents which have been previously registered, are stored as one set of the required data, and the date data, time data and schedule contents are read out in accordance with the searching operation so as to be displayed on the display unit.

When the arbitrary data is searched from the memory in order to be displayed on the display unit, both the searching operation by the date data, and the searching operation by the heading character of the schedule contents can be performed. However, the searching operation by the time data cannot be executed in the conventional electronic scheduler. When, for instance, the time instant data "10:00" is entered into the conventional electronic scheduler, the data which have been stored as to the time data "9:00 to 12:00" are not searched.

Also in such a conventional electronic scheduler, the data within the previously registered range are merely read out and then displayed on the display unit. However, the empty time cannot be searched from the stored data. In this case, the electronic scheduler holder must judge with his own judgement the empty time while sequentially reading out each of the various schedule data, resulting in a trouble-some searching operation.

SUMMARY OF THE INVENTION

The present invention has been accomplished so as to overcome the above-described various drawbacks according to the conventional electronic scheduler. It is therefore an object of the invention to provide an electronic scheduler in which the data searching operation based upon the time can be readily performed with respect to the schedule data having the time range.

An electronic scheduler according to the invention comprises: memory means for storing plural schedule data by combining at least time range data with schedule information; means for entering time data as searching information; means for judging whether or not the schedule data corresponds to the data to be searched, according to a comparison result between the time data entered by said entering means and the time range of the respective schedule data stored in said memory means; and, means for displaying the corresponding schedule data based upon the above-described judgement result.

BRIEF DESCRIPTION OF THE DRAWINGS

For a better understanding of the above-described object of the present invention, reference is made to the following detailed description of the invention to be read in conjunction with the drawings, in which.

DETAILED DESCRIPTION OF THE PREFERRED EMBODIMENT

Circuit Arrangement of Electronic Scheduler

Figure 1:
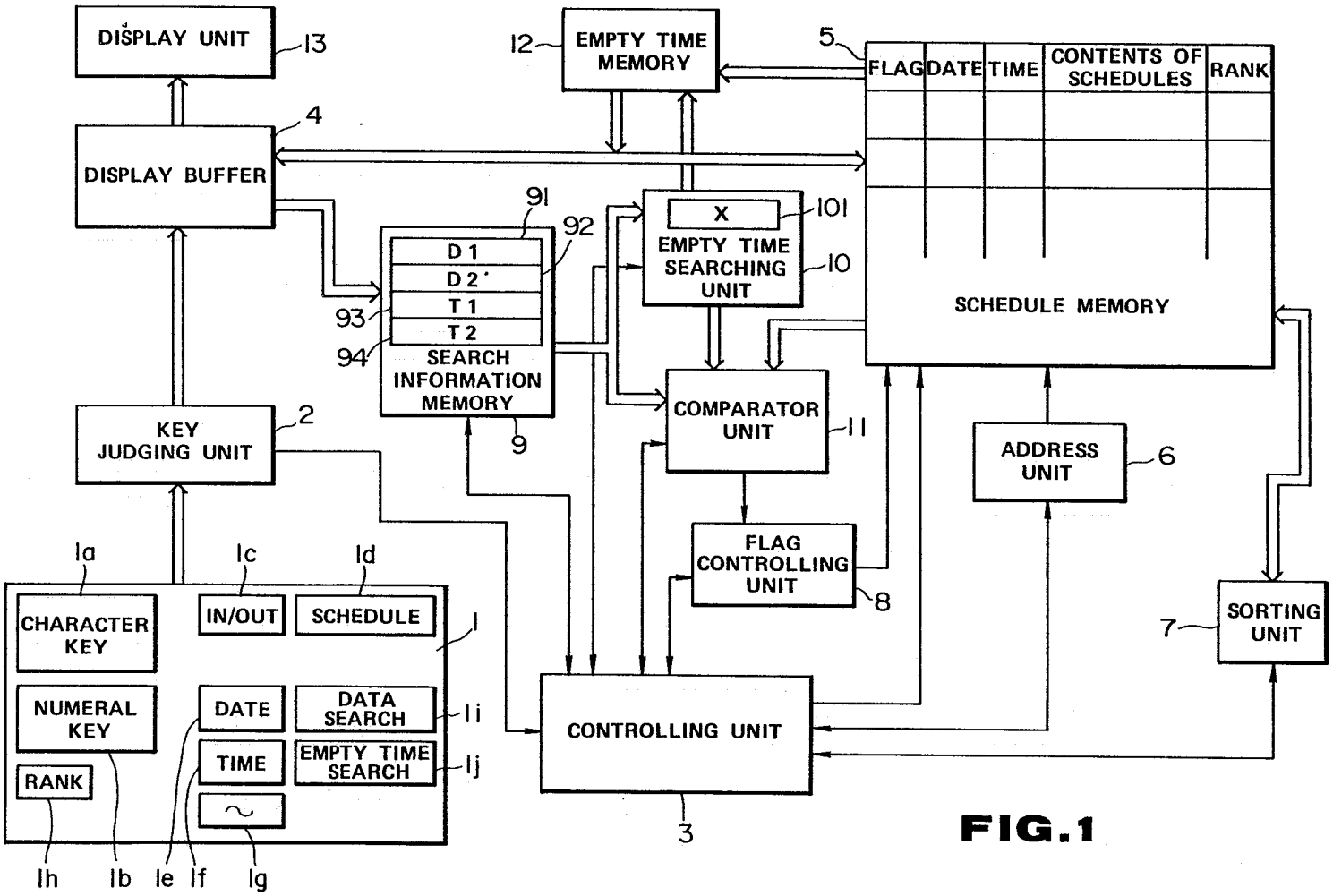
FIG. 1 is a schematic block diagram of an electronic scheduler according to one preferred embodiment of the invention.

In FIG. 1, there is shown a circuit arrangement of an electronic scheduler according to one preferred embodiment of the invention.

The electronic scheduler is constructed of a key entry unit 1; a key judging unit 2; a controlling unit 3; a display buffer 4 and other circuits. The key entry unit 1 includes: character keys 1*a*; numeral keys 1*b*; an "IN/-OUT" key 1*c* for designating input/output modes; a "Schedule" key 1*d* for entering a schedule; a "Date" key 1*e* for entering date data; a "Time" key 1*f* for entering time data; a ~ key 1*g*; a "RANK" key 1*h* for designating ranks of the entered schedules; a "Data Search" key 1*i* for executing the data search operations; and an "Empty time search" key 1*j* for performing empty time search operations.

The key input (entry) data entered from this key entry unit 1 are transferred to the key judging unit 2. Based upon the judging results by this key judging unit 2, the execution data is supplied to the controlling unit 3, and the entry data is supplied to the display buffer 4.

The controlling unit 3 previously stores a program to control various circuits. In other words, this controlling unit 3 is arranged by a ROM (read only memory) and a control circuit for supplying control commands to the respective circuits to be controlled in accordance with the program. In the preferred embodiment, this controlling unit 3 sends various control commands to a schedule memory 5, an address unit 6, a sorting unit 7, a flag controlling unit 8, a search information memory 9, an empty time search unit 10, and a comparator unit 11, which are involved in the electronic scheduler shown in FIG. 1.

The display buffer 4 stores the various data entered by the various key operation. Also, this display buffer 4 transfers these entered data to the schedule memory 5, and receives the stored data from the schedule memory 5 and an empty time memory 12. The memory contents of the display buffer 4 are displayed. The empty time memory 12 and the display unit 13 are included in the electronic scheduler shown in FIG. 1.

Figures 2, 3:
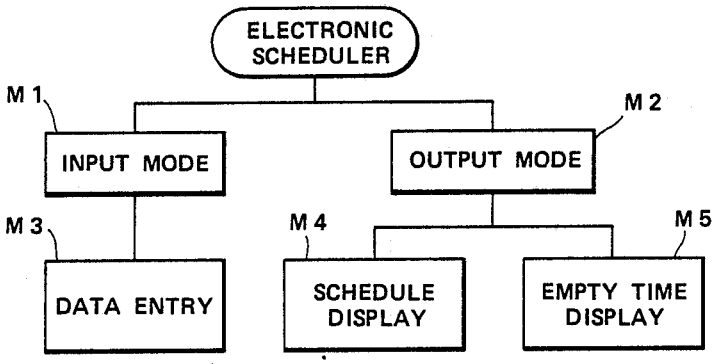
FIG. 2 schematically illustrates an arrangement of a scheduler memory employed in the electronic scheduler shown in FIG. 1.
FIG. 3 is a schematic diagram for explaining functions of the electronic scheduler according to the preferred embodiment.

The schedule memory 5 stores, as illustrated in FIG. 2, a plurality of schedule data each composed by date, time, schedule content, and rank (i.e., very important "A", important "B", and not so important "C"). And the schedule data further contain memory area for a flag F1, and a flag F2. It should be noted that in the preferred embodiment, the writing operation of the schedule data into the schedule memory 5 is performed by operating the sorting unit 7 in such a manner that plural pieces of the schedule data are rearranged in accordance with the date order.

The search information memory 9 includes D1 register 91 and D2 register 92 for storing the date data of the search information, and T1 register 93 and T2 register 94 for storing the time data. Then, the memory contents of the D1 register 91 in the search information memory 9 are transferred to the empty time search unit 10. The empty time search unit 10 includes an X register 101, and the data stored in this X register 101 is registered in the empty time memory 12 according to the control command from controlling unit 3. Functions of the comparator unit 11 are firstly to compare the memory data stored in the search information memory 9 with the data stored in the empty time search unit 10, and secondly to compare the data stored in the empty time search unit 10 with the data stored in the schedule memory 5. The comparison results of this comparator unit 11 are supplied to the flag controlling unit 8. The flag controlling unit 81 controls the flags F1 and F2 of the schedule memory 5 in response to the comparison results of the comparator unit 11.

OPERATIONS OF ELECTRONIC SCHEDULER

Referring now to FIGS. 1 to 3, operations of the electronic scheduler according to the preferred embodiment will be described.

First, functions of the electronic scheduler will be described with reference to FIG. 3.

Upon operation of the IN/OUT key 1*c* of the electronic scheduler, one of the INPUT mode (M1) and OUTPUT mode (M2) is selected in the electronic scheduler. In the INPUT mode (M1), the data can be input, or entered (M3). In the preferred embodiment, the data entry is performed by combining the key operations of the character key 1*a*, numeral key 1*b*, "Date" key 1*c*, "Time" key 1*f*, for key 1*g*, and "RANK" key 1*h*. Then, the entered data are stored into the schedule memory 5, as illustrated in FIG. 2. In this case, the rank (very important "A", important "B", and not so important "C") of the entered data depending upon the importance degree of the entered data is also input into the schedule memory 5.

In the OUTPUT mode (M2), both the schedule display (M4) and empty time display (M5) can be performed. The schedule display (M4) performs data searching and displaying when the search information is entered, and the data search key 1*i* is operated.

SEARCHING OPERATION FOR SCHEDULE DATA

A description will now be made of the searching operation on the data representative of "June 10, 1988; 10:00 AM" searched from the schedule data which have been stored in the schedule memory 5 with reference to a flow operation.

Figure 4A:
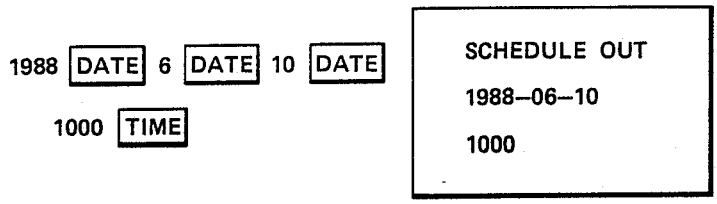
FIGS. 4A to 4D schematically illustrate relationships between the key operations of the data search and the display conditions of the electronic scheduler shown in FIG. 1.
Figure 4B:
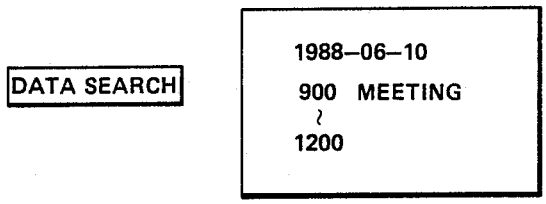

FIGS. 4A and 4B illustrate the key operations of the schedule data searching and the display conditions of display unit 13. In the initial condition, the output mode of the scheduler is set by the IN/OUT key 1*c*. Thereafter, as illustrated in FIG. 4A, the key entry operation is carried out by operating the character key 1*a*, numeral key 1*b*, Date key 1*e*, and Time key 1*f* so as to entry the data representative of "June 10, 1988, 10:00 AM", under the following data entry sequence: "1988", "Date", "6", "Date", "10", "Date", "1000", and "Time". In response to the key entry operations, both the date data and time data are stored in the display buffer 4, and simultaneously, as illustrated in FIG. 4A, the characters representative of the output mode "SCHEDULE OUT", the date data to be searched "1988-06-10", and the time data to be searched "1000" are displayed on the display unit 13. At the same time, the date data "1988-06-10" is transferred from this display buffer 4 to the D1 register 91 in the search information memory 9, the time data "1000" is also transferred to the T1 register 93.

Figure 5:
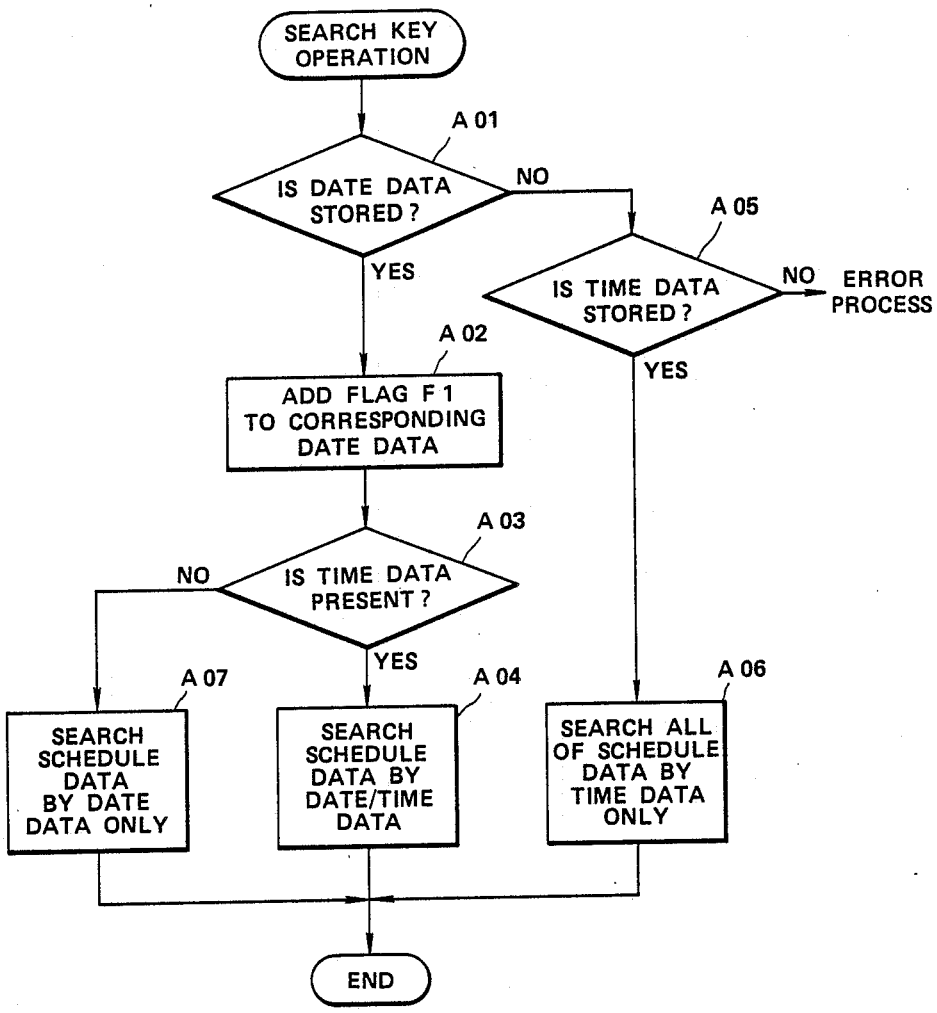
FIGS. 5 and 6 are flowcharts for explaining the data search operations.

Then, as shown in FIG. 4B, when the "data search" key 1*i* is operated to designate the data search operation, the control process of this key operation will be performed as shown in FIG. 5.

First, in the flowchart of FIG. 5, at a step A01, a check is made whether or not the date data have been set as the search information in the D1 register 91 of the search information memory 9. In the preferred embodiment, since the date data "1988-06-10" has been stored in the register 91, this is judged by the controlling unit 3. Thereafter, the control process is advanced to a step A02 where the date data is sequentially read out from the schedule memory 5 to the comparator unit 11, this readout date data is compared with the date data stored in the D1 register 91 of the search information memory 9, and the flag F1 is added to the related schedule data after coincidence is made. At the subsequent step A03, a judgement is made whether or not the time data has been stored as the search information into the T1 register 93 of the search information memory 9. In this case, since the time data "1000" has been stored in this T1 register 93, this fact is judged by the controlling unit 3. Then, the control process is advanced to a step A04. In this step A04, the search operation is performed to search the schedule data containing both the date data and time data from a plurality of schedule data which have been stored in the schedule memory 5. That is, since the flag F1 has been added to the schedule data corresponding to the date data in question, the search operation is made on the corresponding time data with respect to the flag "F1"-added schedule data in accordance with a control flow as shown in FIG. 6.

Figure 6:
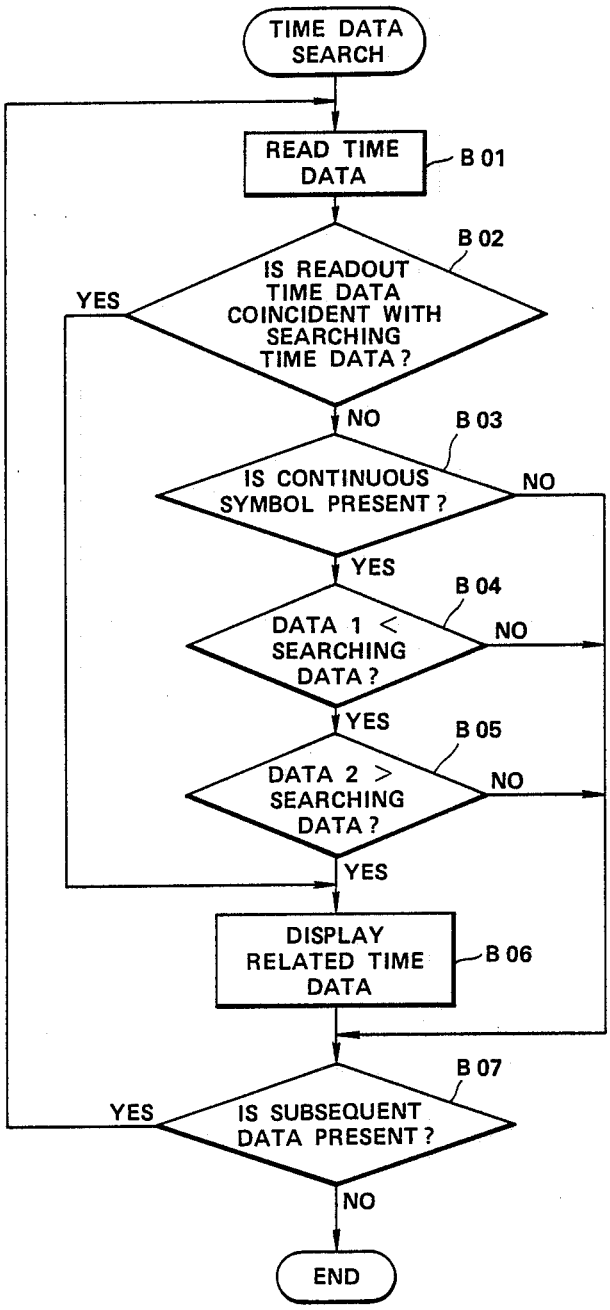

In the flowchart shown in FIG. 6, the time data "900~1200" which is first schedule data stored in schedule memory 5, are sequentially read out at a first step B01. In the net step B02, a check is made whether or not the readout time data is coincident with the time data "1000" to be searched. This implies that a judgement is made whether or not the time data "1000" is directly contained in the readout time data. If the readout time data are, for instance, "1000~1200", the time data "1000" is coincident with the readout time data "1000", so that the judgement result is YES. However, in this case, the judgement is made NO and then the control process is advanced to the subsequent step B03. In this step B03, a check is made whether or not a continuous symbol "~" is contained in the readout time data. In the preferred embodiment, the judgement result is YES and the control process is advanced to a succeeding step B04. In this step B04, the time data "900" among the time data "900~1200" is set as data 1 and the time data "1200" is set as data 2. Then, a check is made whether or not the data 1 is advanced to the above-described searching time data in view of time lapse. In the preferred embodiment, since the data 1 corresponds to "900" and the searching time information corresponds to "1000", then the judgement result is YES. Thereafter, the control process is advanced to the next step B05. In this step B05, a check is made whether or not the data 2 exceeds the above-described searching time data in view of time lapse. In the preferred embodiment, since the data 2 "1200" exceeds the searching time data "1000", the judgement result becomes YES. When, as previously described, the time data "1000" of the searching information is present within the time range between the data 1 and data 2, namely, this searching time data "1000" is related with the time data "900~1200", the control process is advanced to a next step B06. In this step B06, both the time data "900~1200" read out as the related data from the search information memory 9 and the contents of the corresponding schedules "MEETING" are transferred to the display buffer 4, and displayed on the display unit 13. Thereafter, in the succeeding step B07, a judgement is made whether or not the subsequent searching schedule data is present in the schedule memory 5. If NO, then this time data searching operation is accomplished. To the contrary, if YES, then the control process is again repeated from the first step B01. It should be noted that when in the previous step B02, the time data as the searching information is directly coincident with the time data read out from the schedule memory 5, no data processing is required in the steps B03 to B05, and accordingly, the schedule data is displayed at the step B06. Also, when the respective judgement results at the steps B03, B04 and B05 become NO, then the control process is advanced to the step B07 so as to search the next searching time data since this readout time data is not related with the time data of the searching information.

SCHEDULE DATA SEARCH BY USING ONLY TIME DATA

A description will now be made of the schedule data searching operation by using only the time data and without using the date data.

Figure 4C:
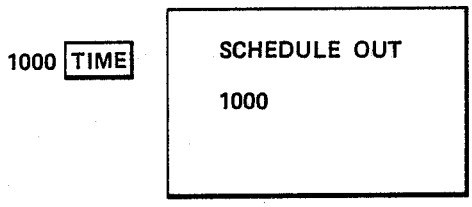

As illustrated in FIG. 4*c*, to enter the time data representative of "10:00AM", the numeral key 1*b* and "Time" key 1*f* respectively indicating 1000 and time are depressed. Upon operation of the keys, the desired time data is held in the display buffer 4, and also, as illustrated in FIG. 4*c*, both the character "SCHEDULE OUT" representative of the output mode of the scheduler and the time data "1000" to be searched (i.e., the searching time data) are displayed on the display unit 13. At the same time, the time data 1000 is transferred from this display buffer 4 to the T1 register 93 of the search information memory 9.

Figure 4D:
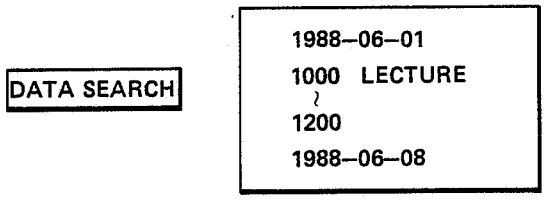

Thereafter, as illustrated in FIG. 4D, when the "DATA SEARCH" key 1 is manipulated so as to designate the time data search operation, a control process, defined in FIG. 5, with respect to the key operation will now be commenced.

In the flowchart shown in FIG. 5, a check is made whether or not the date data as the searching information has been set in the D1 register 91 of the search information memory 9. In this preferred embodiment, this date data has not yet been set, resulting in NO. Accordingly, the control process is advanced to the next step A05. In this step A05, another check is made whether or not the time data as the searching information has been set in the T1 register 93 of the search information memory 9. In the preferred embodiment, since the time data "1000" has been set in this T1 register 93, the judgement result is YES. As a result, the control process is advanced to the succeeding step A06. In this step A06, the searching operation is carried out by the time data for all of the schedule data previously stored in the schedule memory 5, by employing the control process as described in FIG. 6.

As a result of this time data searching operation, if there are schedule data on June 1 and June 8 corresponding to the time data, the display unit 13 displays the condition as shown in FIG. 4D. It is possible to look at each schedule data by display scrolling.

FUNCTION OF EMPTY TIME DISPLAY (M5)

Figure 7A:
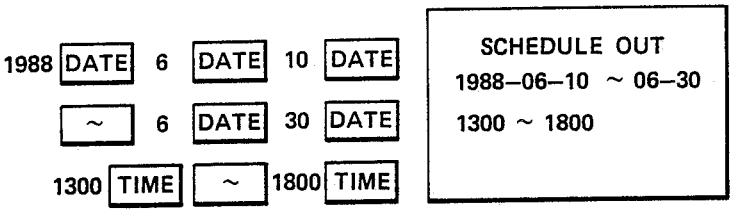
FIGS. 7A and 7B schematically illustrate relationships between the key operations of the empty time search and the display conditions of the electronic scheduler shown in FIG. 1; and, FIGS 8 to 11 are flowcharts for explaining the search operations of the empty time.
Figure 7B:
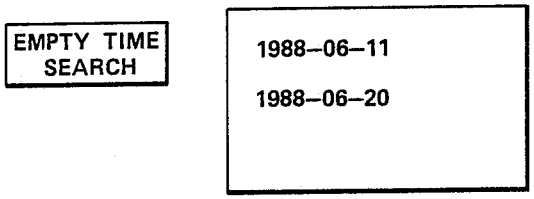

A function of the empty time display will now be described. That is, the function of the empty time display is first to search the day on which no schedule is made for the searching information by operating the "EMPTY TIME SEARCH" key 1*j* after the search information is entered, and secondly to display the search result (see FIGS. 7A and 7B).

The detailed function of the above-described empty time searching operation will now be described with reference to FIG. 8. In a step C01 of a flowchart shown in FIG. 8, the searching information is entered by means of the key entry unit 1. In the preferred embodiment, this searching information is entered in such a manner that the date data are entered as d1 to d2, and the time data are input as t1 to t2. This searching information is transferred to the search information memory 9, where the date data "d1" is written into the D1 register 91, the date data "d2" is written into the D2 register 92, the time data "t1" is stored into the T1 register 93 and the time data "t2" is stored into the T2 register 94.

Figure 9:
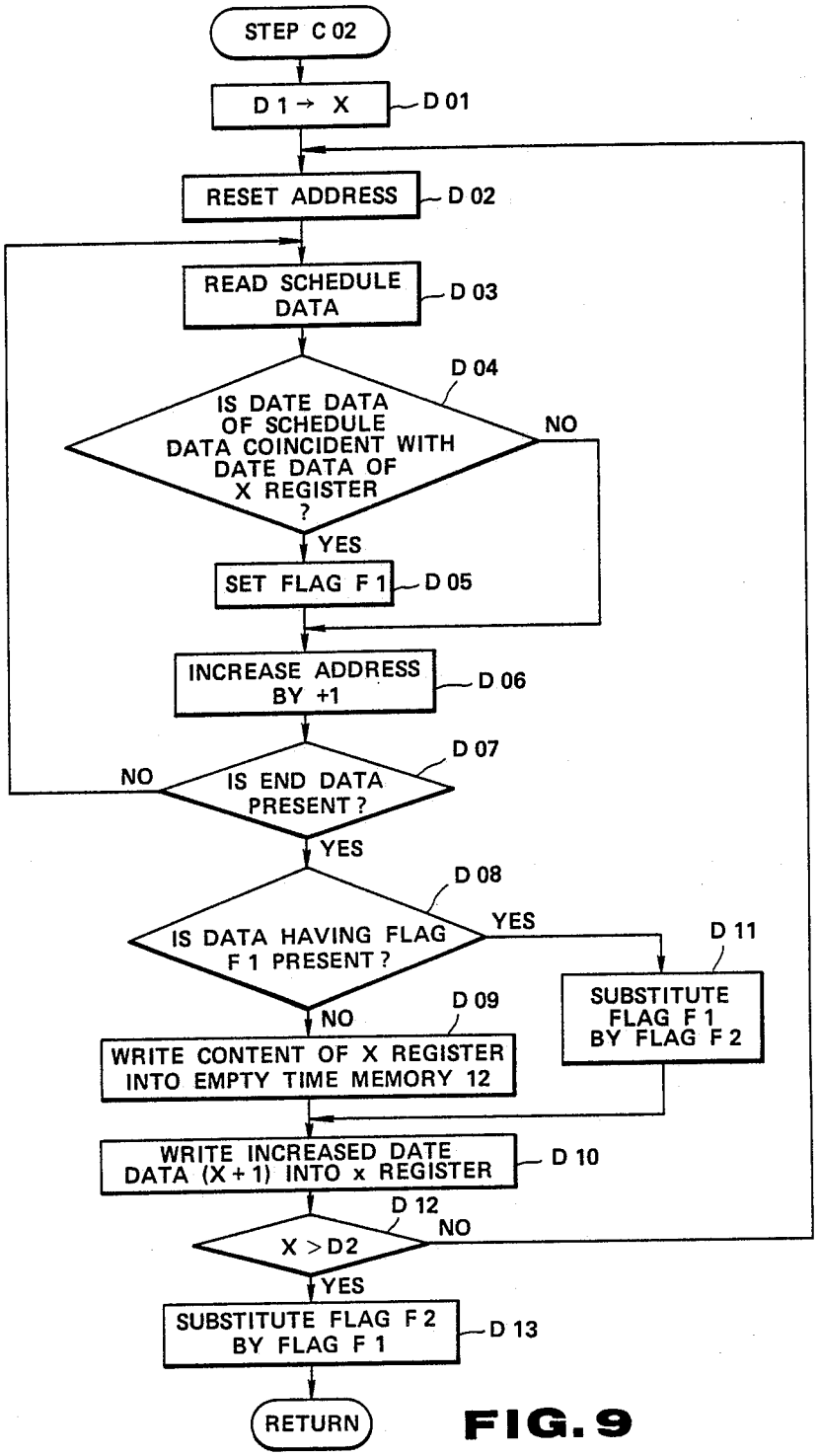

Then, the control process is advanced to the subsequent step C02, the searching operation is carried out for the day on which no schedule is made. The detailed operation of this step C02 is illustrated in FIG. 9. In a flowchart shown in FIG. 9, at a first step D01, the date data "d1" stored in the D1 register 91 of the search information memory 9 is written into the X register 101 of the empty time searching unit 10.

Thereafter, the control process is advanced to a step D02 at which the address of the address unit 6 is reset, and then in the next step D03, the initial schedule data stored in the schedule memory 5 is read out. Thereafter, in the subsequent step D04, a judgement is made in the comparator unit 11 whether or not the date data of the first, or initial schedule data stored in the schedule memory 5 is coincident with the date data stored in the X register 101 of the empty time search unit 10. In the preferred embodiment, if the judgement result is YES by checking the coincidence between the date data of the first schedule data and the date data stored in the X register 101, the control process is advanced to the subsequent step D05. In this step D05, the flag F1 of the first schedule data stored in the schedule memory 5 is set under the control of the flag controlling unit 8. Then, the control process is advanced to the subsequent step D06. If on the other hand, there is not coincidence between the date data of the first schedule data and the date data stored in the X register 101, namely NO, accordingly, the control process is directly advanced to this step D06.

In this step D06, the address of the address unit 6 is increased by +1, and thereafter, a judgement is made whether or not the data of the schedule memory 5 corresponds to the end data. If NO in this step D07, the control process is returned to the previous step D03 at which the subsequent schedule memory 5 is read out. Thus, the readout schedule data is further processed in accordance with the step D04 and the subsequent steps.

Meanwhile, when the final schedule data stored in the schedule memory 5 is processed, the judgement result at the step D07 becomes YES and then the control process is advanced to a new step D08. In this step D08, a judgement is made whether or not there is the schedule data to which the flag F1 has been added. If the judgement result is NO, then the judgement is made that there is no data coincident with the date data "d1", and thus the control process is advanced to the step D09. In other words, the judgement is made that as to the date data "d1", the schedule is empty. In the next step D09, the content of the X register 101 in the empty time searching unit 10, i.e., the date data "d1" in the preferred embodiment, is written in the empty time memory 12 and thereafter the control process is advanced to a step D10. In the previous step D08, if the judgement result is YES, on the other hand, the SET flag F1 is substituted by the flag F2 in step D11 and then the control process is advanced to the step D10.

In this step D10, the content of the X register 101 of the empty time searching unit 10 is increased by +1, and the date data "d1+1" is written therein. Then, the control process is advanced to the next step D12, where a judgement is made whether or not the content of the X register 101 is greater than the other date data "d2". In this judging step D12, if No, then the control process is returned to the step D02. As a result, the data process defined by the above step D03 and the succeeding steps is repeatedly performed as to the date data "d1+1". Thereafter, when the content of the X register 101 of the empty time searching unit 10 becomes greater than the time data of the D2 register 92 and the judgement result at the step D12 becomes YES, all of the SET flag F2 are substituted by the flag F1 in the next step D13. Consequently, the control process is returned to the flowchart shown in FIG. 8.

Figure 8:
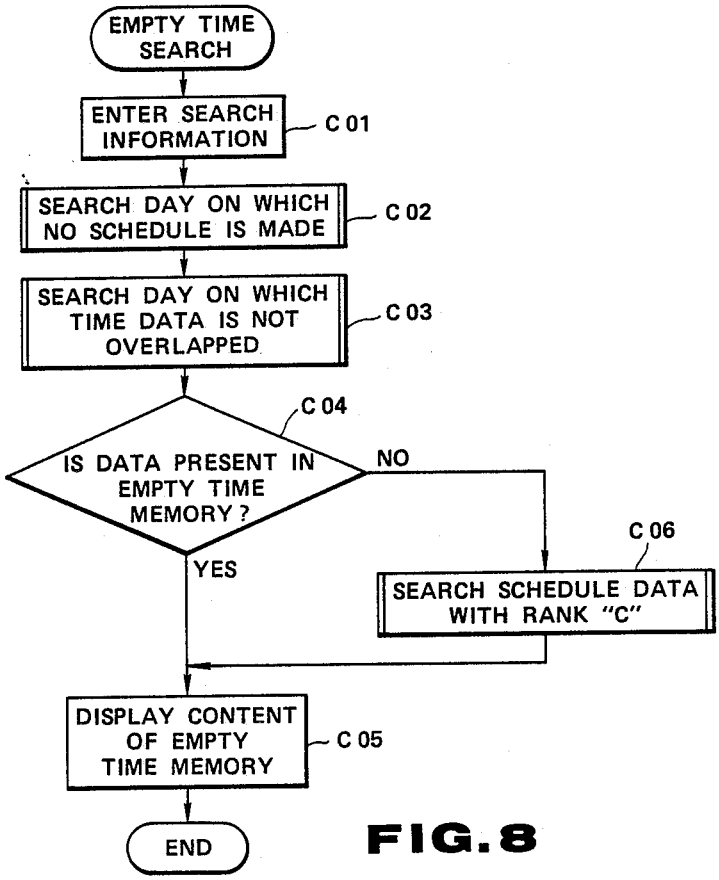

That is, in the previous step C02 of the flowchart illustrated in FIG. 8, the date data on which no schedule is established within the range between the date data "d1" and "d2" of the searching information, is written into the empty time memory 12, and the flag F1 is set to the schedule data of the schedule memory 5 within the range between the date data "d1" and "d2".

Then, the control process is advanced to the step C03, where the searching operation is made to the day on which the time data are not overlapped. The detailed searching operation executed in this step C03 is illustrated in a flowchart shown in FIG. 10.

SEARCH FOR NO OVERLAPPED TIME DATA

Figure 10:
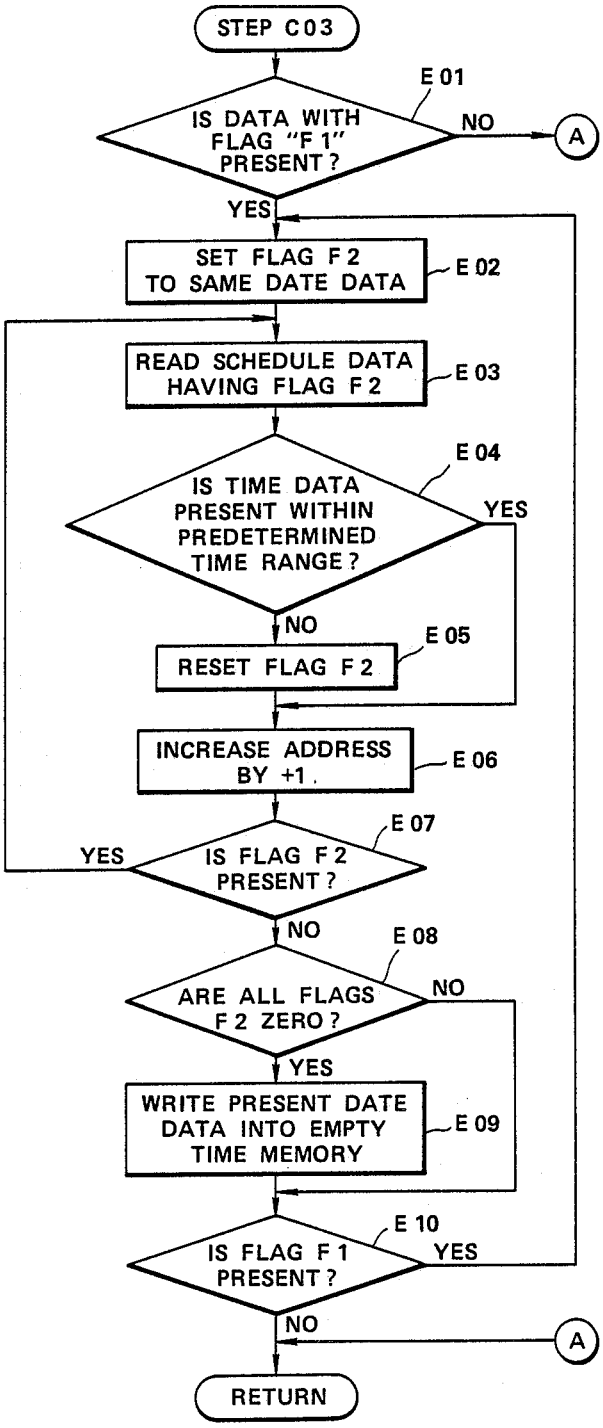

The control process as described in the flowchart shown in FIG. 10, is to check whether or not the schedule is engaged during the time period from $t_1$ to $t_2$ as to the data to which the flag F1 is added (i.e., the schedule being engaged). In a first step E01, a judgement is made whether or not the schedule data with the flag F1 is present in the schedule memory 5. If No, then the control process is immediately returned to the control process illustrated in FIG. 8, where the operation of the step C04 is executed. If, on the other hand, the judgement result is YES, the control process is advanced to the next step E02. In the step E02, the other flag F2 is set on the schedule data having same date. In the preferred embodiment, the flag F2 is added to such schedule data that this schedule data has the first same date data which is selected from the schedule data having the flag F1 located in the smallest address.

Then, at the subsequent step E03, the first schedule data to which the flag F2 has been added is read out. Thereafter, in a step E04, the comparator unit 11 judges whether or not the time data of the corresponding schedule data is present within the time range $t_1$ to $t_2$ where this time data has been written into the registers 93 and 94 of the search information memory 9. In this step E04, if No, then the control process is advanced to the succeeding step E05 where the flag F2 of the corresponding schedule data is reset by the flag controlling unit 8. Then, the control process is advanced to a step E06. In the previous step E04, if YES, then the control process is directly advanced to this step E06.

In the step E06, the address of the address unit 6 is increased by +1. In the subsequent step E07, a judgement is made whether or not the flag F2 is present in the next data. If YES, the control process is returned to the previous step E03 at which the subsequent same date schedule data is read out. Then, the control processes defined by the next step E04 and the subsequent steps are repeated for this subsequent same date schedule data.

To the contrary at the step E07, if the judgement result is No, then the control process is advanced to a step E08. In this step E08, a judgement is made whether or not all of the flags "F2" correspond to "0". In the preferred embodiment, if all of the time data belonging to the first same date schedule data are not overlapped with time periods $t_1$ to $t_2$, the judgement result becomes YES because all of the flags F2 are reset and correspond to "0". Then, the control process is advanced to the next step E09 at which the date data at this time is written into the empty time memory 12, and thereafter, the control process is advanced to a step E10. If, to the contrary, the judgement result is NO at the step E08, the control process is immediately advanced to the step E10. In this step E10, a further judgement is made whether or not the flag F1 is present on the subsequent other data. If YES, then the control process is returned to the previous step E02, at which the flag F2 is set to the subsequent same date schedule data. Then, this subsequent same date schedule data will be processed in the subsequent steps as described above. To the contrary, if the judgement result is NO at the step E10, the control process is returned to the control process as described in FIG. 8.

That is, in the step C03 of FIG. 8, the date data which is not overlapped with the time periods t1 to t2 within the date range between d1 to d2, is written in the empty time memory 12. It should be understood that the flag F2 is set to the schedule data which is overlapped with the time period t1 to t2.

Figure 11:
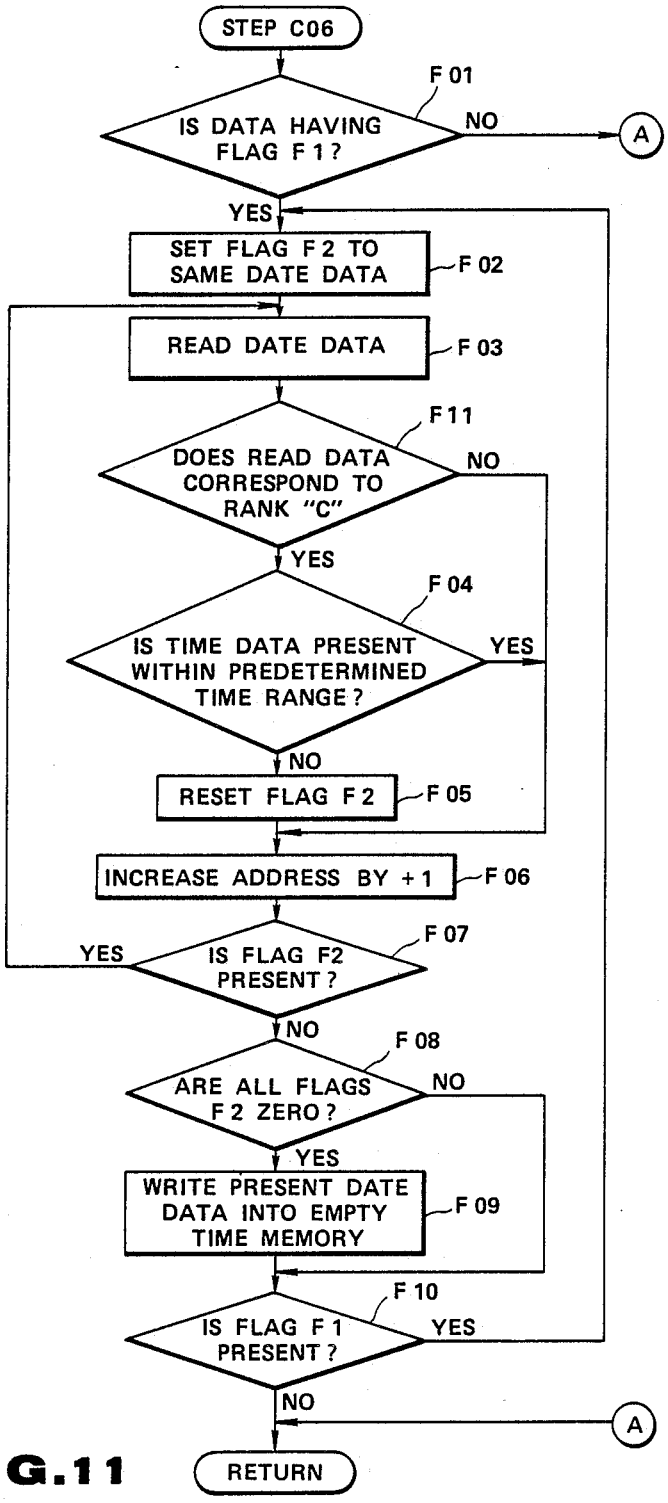

In the flowchart shown in FIG. 8, the control process is advanced to a step C04, at which a judgement is made whether or not the data is present in the empty time memory 12. If YES in this step C04, then the control process is advanced to the next step C05 at which the memory content of the empty time memory 12 (i.e., the date on which the schedule is empty) is displayed via the display buffer 4 on the display unit 13. If, on the other hand, the judgement result is NO, namely, no empty time is present, the control process is advanced to a step C06. In the step C06, the schedule data, the rank of which is not so important (rank "C") is searched. The control process at this step C06 will now be described with reference to FIG. 11. In the preferred embodiment, the control processes defined by steps F01 to F11 shown in FIG. 11 are substantially equal to those of the FIG. 10. It should be, however, noted that when the data is read out at the step F03, a judgement is made whether or not the rank of the readout data corresponds to the rank "C" (i.e., not so important) in a step F11. Then, if the judgement result becomes YES, the control processes defined by the step F04 and the subsequent steps are executed. If, to the contrary, the judgement result becomes NO, then the control process is advanced to the step F06. In this step F06, the address of the address unit 6 is increased by +1, and thereafter the control processes defined by the step F07 and the subsequent steps are performed. Since the remaining control processes are the same as those of FIG. 10, no further explanation is made here.

While the invention has been described in detail, the electronic scheduler, according to the invention, having the following particular advantages can be provided. That is, in the electronic scheduler wherein the time data representative of the time range by employing two pieces of time data, has been stored together with the date data and schedule contents, once a time to be searched is designated, a judgement of the search operation is made whether or not this time data is present within the range between two pieces of the time data. Accordingly the searching operation by the time data is practicable. More specifically, the searching operation can be also performed for the time range defined by two pieces of the time data.

Also in accordance to the invention, in the electronic scheduler, when both the date data and time data are entered as the searching information, the day on which no schedule is made is searched based upon the date data, and simultaneously, the day on which the time data are not overlapped with each other is searched with respect to the day on which the schedule is engaged, and the empty time is automatically searched based on these search results. As a consequence, the empty time within the desired time range can be quickly searched, as compared with the conventional electronic scheduler wherein the empty time is searched by the manual operation while the schedule data are sequentially read out from the schedule data memory. An adjustment of the schedule for the electronic scheduler holder can be readily performed by utilizing the searched empty time.

What is claimed is:

1. An electronic scheduler, comprising:
memory means for storing plural schedule data, including means for combining at least time range data defined by first time data and second time data with corresponding schedule information;
means for entering time data as searching information into the electronic scheduler;
means for judging whether or not the time data entered by said entering means is present between the first time data and the second time data of the schedule data stored in said memory means; and
means for displaying schedule data with time range data defined by said first and said second time data when said judging means judges that the entered time data corresponds to a time between the first time data and the second time data.

2. An electronic scheduler according to claim 1, wherein the schedule data stored in said memory means contains the date data.

3. An electronic scheduler according to claim 2, further comprising:
means for entering the date data; and
means for judging whether or not the entered date data is coincident with the date data of the respective schedule data, whereby the time range is compared only for the coincident date schedule data.

4. An electronic scheduler, comprising:
first memory means for storing plural schedule data, including means for combining date data and time data with schedule information;
means for entering time data;
means for reading out time data from schedule data stored in said first memory means;
means for judging whether or not a relationship exists between entered time data and time data read out by said reading means;
means for defining a day having associated time data that is judged by said judging means as having no relationship to the entered time data, as a no-schedule day; and
means for outputting the day defined as a no-schedule day by said defining means.

5. An electronic scheduler according to claim 4, further comprising:
means for entering first date data;
second memory means for storing the first date data entered by said entering means;
means for increasing the date data stored in the second memory means by one day;
means for comparing the date data stored in the second memory means with the date of the schedule data stored in said first memory means; and
means for operating said judging means to indicate a relationship when said comparing means detects a coincident result.

6. An electronic scheduler according to claim 5, further comprising:
means for entering second date data, and
means for controlling said increasing means to increase the first date data stored in said second memory means by said second date data.

7. An electronic scheduler according to claim 5, further comprising:
means for storing rank data related to each schedule data stored in said first memory means; and
means for detecting a relatively low level rank from among the rank data stored in said rank data storing means.

8. An electronic scheduler according to claim 7, further comprising:
means for determining a day associated with a low level rank as detected by said detecting means, as a no-schedule day, when said defining means fails to define a no-schedule day among the schedule data stored in said first memory means.

* * * * *